US009754445B2

(12) United States Patent
Milligan et al.

(10) Patent No.: US 9,754,445 B2
(45) Date of Patent: Sep. 5, 2017

(54) STRESS DETECTING INPUT DEVICE FOR A GAMING MACHINE

(71) Applicant: Video Gaming Technologies, Inc., Franklin, TN (US)

(72) Inventors: DAniel William Milligan, Palmyra, VA (US); Ben Lechlitner, Nashville, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 242 days.

(21) Appl. No.: 14/145,738

(22) Filed: Dec. 31, 2013

(65) Prior Publication Data

US 2015/0187171 A1 Jul. 2, 2015

(51) Int. Cl.
*A63F 9/24* (2006.01)
*G07F 17/32* (2006.01)

(52) U.S. Cl.
CPC ..... *G07F 17/3227* (2013.01); *G07F 17/3204* (2013.01); *G07F 17/3237* (2013.01)

(58) Field of Classification Search
USPC ..... 463/16–42
See application file for complete search history.

(56) References Cited

U.S. PATENT DOCUMENTS 5,772,508 A 6/1998 Sugita et al.
5,857,986 A 1/1999 Moriyasu
6,450,820 B1 9/2002 Palsson et al.
7,470,191 B2 12/2008 Xidos et al.
8,167,710 B2 5/2012 Agarwal et al.
8,298,078 B2 10/2012 Sutton et al.
8,308,562 B2 11/2012 Patton
8,652,040 B2 * 2/2014 LeBoeuf ..... A61B 5/0059 600/301
2006/0071912 A1 4/2006 Hill et al.
2008/0146890 A1 * 6/2008 LeBoeuf ..... A61B 5/0059 600/300
2009/0270170 A1 * 10/2009 Patton ..... A63F 13/10 463/36
2009/0325693 A1 12/2009 Ron
2010/0123588 A1 5/2010 Hernandez
(Continued)

OTHER PUBLICATIONS

PCT International Search Report and Written Opinion for related matter PCT/US2014/072746 dated Apr. 28, 2015; 15 pp.

*Primary Examiner* — Masud Ahmed
(74) *Attorney, Agent, or Firm* — Armstrong Teasdale LLP

(57) ABSTRACT

A gaming system that includes an input device with a sensor configured to measure data associated with an interaction of a player with the input device during play of a game on the gaming machine. The gaming system further includes a processor programmed to receive measured data from the sensor, determine, from the received measured data, that the interaction of the player with the input device exceeds an acceptable interaction threshold level, associate one or more gaming events that correspond to the determination that the interaction of the player with the input device exceeds the acceptable interaction threshold level, and determine a mental state of the player based on: the associated one or more gaming events, and the determination that the interaction of the player with the input device exceeds the acceptable interaction threshold level.

26 Claims, 4 Drawing Sheets

(56) References Cited

U.S. PATENT DOCUMENTS

| | | | | |
|---|---|---|---|---|
| 2011/0201414 | A1* | 8/2011 | Barclay | G07F 17/3206 463/25 |
| 2013/0337889 | A1* | 12/2013 | Gagner | G07F 17/3209 463/25 |
| 2014/0051948 | A1* | 2/2014 | LeBoeuf | A61B 5/0059 600/301 |
| 2014/0058220 | A1* | 2/2014 | LeBoeuf | A61B 5/0059 600/301 |

* cited by examiner

STRESS DETECTING INPUT DEVICE FOR A GAMING MACHINE

BACKGROUND OF THE INVENTION

The embodiments described herein relate generally to gaming machines and, more particularly, to systems and methods for detecting a mental state of a player during play of game of chance on a gaming machine.

Although playing a game of chance is typically fun, the general aspects of risk may make the overall experience both exciting and stressful at the same time. As such, stress related to playing a game of chance can be very common among players. Unfortunately, as stress builds, a player may become depressed, fatigued, anxious, or even aggressive. However, players are routinely unaware that they are affected with stress related to playing a game of chance.

Conventionally, stress detection involves capturing biofeedback data from the player. Such biofeedback data may include detection of a variety of physiological characteristics, such as pulse, skin resistance, respiration rate, vocal characteristics, pupil dilation, and body temperature. However, to capture biofeedback data, systems are required to include, for example, infrared cameras, pupil scanners, body movement sensors, body temperature sensors, blood pressure sensors, pulse sensors, among other stimulus detection sensors. In addition, systems that provide an ability for players to play responsibly require a player to have a player tracking card to link with a player profile, which details particular parameters for the player that can be measured/detected. However, this not only requires a player to utilize a player tracking card, but this requires a player to provide "normal" biometric data to a gaming establishment in order to activate this feature.

BRIEF DESCRIPTION OF THE INVENTION

In one aspect, a gaming system is provided. The gaming system includes an input device that includes a sensor configured to measure data associated with an interaction of a player with the input device during play of a game on the gaming machine. The gaming system further includes a processor programmed to receive measured data from the sensor, determine, from the received measured data, that the interaction of the player with the input device exceeds an acceptable interaction threshold level, associate one or more gaming events that correspond to the determination that the interaction of the player with the input device exceeds the acceptable interaction threshold level, and determine a mental state of the player based on: the associated one or more gaming events, and the determination that the interaction of the player with the input device exceeds the acceptable interaction threshold level.

In another aspect, a method for determining a mental state of a player during play of a game on a gaming machine is provided. The method includes receiving, from a sensor of an input device, data associated with an interaction of the player with the input device during play of the game on the gaming machine, determining, from the received data, that the interaction of the player with the input device exceeds an acceptable interaction threshold level, determining one or more gaming events corresponding to the determination that the interaction of the player with the input device exceeds the acceptable interaction threshold level, and determine a mental state of the player based on: the one or more gaming events, and the determination that the interaction of the player with the input device exceeds the acceptable interaction threshold level.

In yet another aspect, an input device that enables a player to execute one or more inputs in a game of chance on a gaming machine is provided. The input device includes a sensor configured to measure data associated with an interaction of the player with the input device during play of the game of chance, and a processor. The processor is programmed to receive measured data from the sensor, determine, from the received measured data, that the interaction of the player with the input device exceeds an acceptable interaction threshold level, associate one or more gaming events that correspond to the determination that the interaction of the player with the input device exceeds the acceptable interaction threshold level, and determine a mental state of the player based on: the associated one or more gaming events, and the determination that the interaction of the player with the input device exceeds the acceptable interaction threshold level.

DETAILED DESCRIPTION OF THE INVENTION

Exemplary embodiments of systems and methods for use in detecting a mental state of a player during play of game of chance on a gaming machine are described herein. In particular, since gaming machines include one or more input devices for accepting player input, embodiments described herein utilize a sensor and/or an accelerometer on/within an input device to analyze data in order to determine when a player's stress is increasing, without intruding on a player's life. For example, slot machines often include a "spin" button that enables rotation of physical or simulated reels of the slot machine, and video poker machines include "hold" buttons which each define a singular, unique input, that of designating a card to be held in a draw poker game. Therefore, by analyzing an amount of force applied to these input devices (e.g., a player punching or hitting buttons) and tracking various factors such as win/loss ratios, a player's mental state can be determined/monitored.

Exemplary technical effects of systems and methods described herein include at least one of: (a) receiving, from a sensor of an input device, data associated with an interaction of a player with the input device during play of a game on a gaming machine; (b) determining, from the received data, that the interaction of the player with the input device exceeds an acceptable interaction threshold level; (c) associating one or more gaming events corresponding to the determination that the interaction of the player with the input device exceeds the acceptable interaction threshold level; and (d) determine a mental state of the player based on: the associated one or more gaming events; and the determination that the interaction of the player with the input device exceeds the acceptable interaction threshold level.

Figure 1:
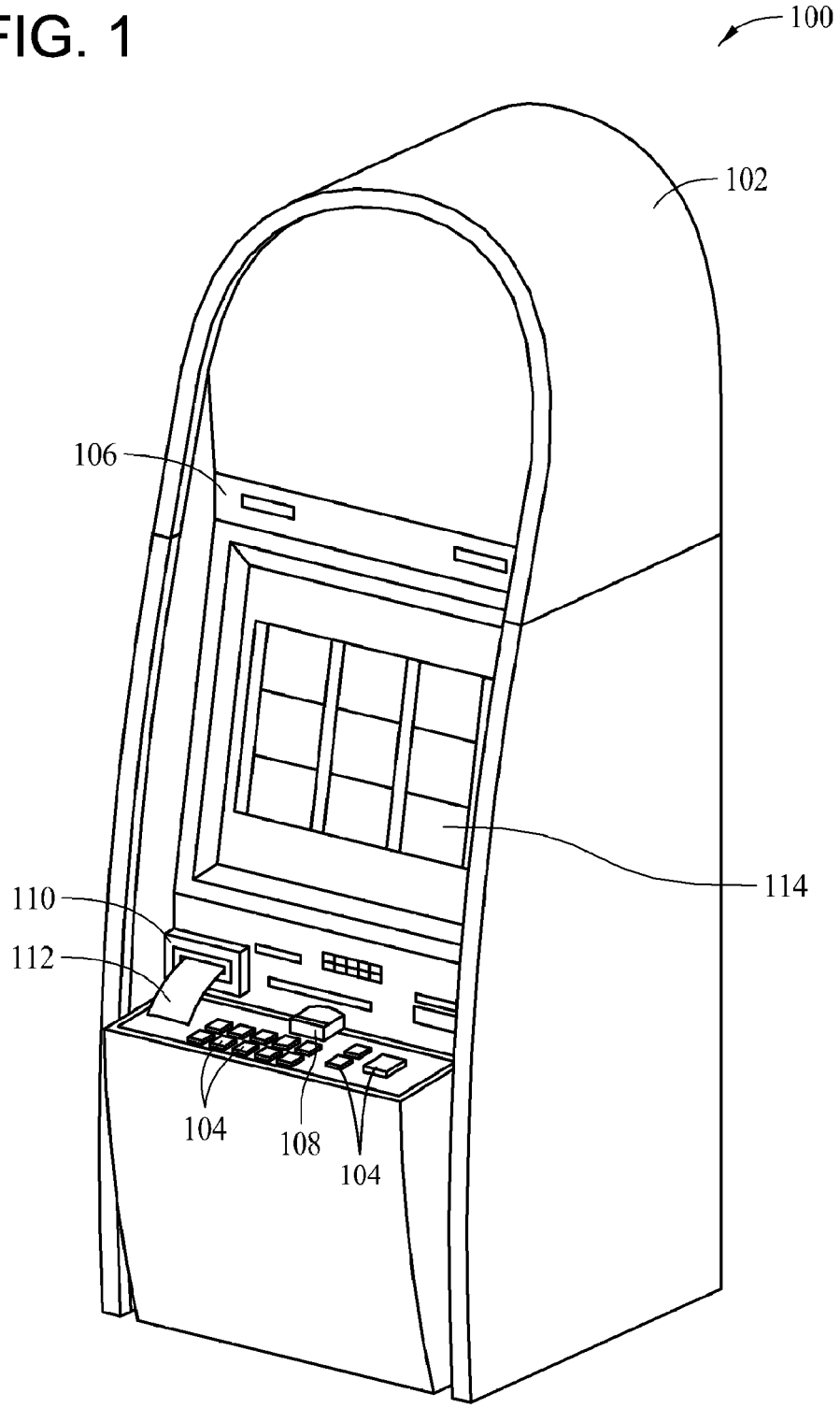
FIG. 1 is a schematic diagram of an exemplary gaming machine.

FIG. 1 is a schematic diagram of an exemplary gaming machine 100 that facilitates enabling a detection of a mental state of a player during play of game of chance on gaming machine 100. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a cabinet 102 configured to house a plurality of components, such as a gaming machine controller, peripheral devices, presentation devices, and player interaction devices. For example, in an exemplary embodiment, gaming machine 100 includes a plurality of input devices, such as a touch screen (e.g., presentation device 114) and switches and/or buttons 104 that are coupled to a front 106 of cabinet 102. Buttons 104 may be used to start play of a primary or secondary game. Buttons 104 may include a "Bet One" button that enables the player to place a bet or to increase a bet, a "Bet Max" button that enables the player to bet a maximum permitted wager, a "Cash Out" button that enables the player to receive a cash payment or other suitable form of payment, such as a ticket or voucher, which corresponds to a number of remaining credits, a "spin" button that enables rotation of physical or simulated reels of the slot machine, and/or a "hold" button (e.g., in video poker) for designating a card to be held in a draw poker game. As explained in further detail below, each of buttons 104 may include an accelerometer and/or one or more sensors that measure data, such as an amount of pressure applied to button(s) 104, an amount of force applied to button(s) 104, duration of force applied to button(s) 104, and/or a frequency of force applied to button(s) 104.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more presentation devices 114. Presentation devices 114 are mounted to cabinet 102, and may include a primary presentation device for displaying a primary game and a secondary presentation device for displaying a secondary or bonus game. Presentation devices 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

In an exemplary embodiment, presentation device 114 is used to display one or more game images, symbols, and/or indicia such as a visual representation or exhibition of movement of an object (e.g., a mechanical, virtual, or video reel), dynamic lighting, video images, and the like. In an alternative embodiment, presentation device 114 displays images and indicia using mechanical means. For example, presentation device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator (RNG), a pseudo-random number generator (PNG), or any other suitable randomization process.

Figure 2:
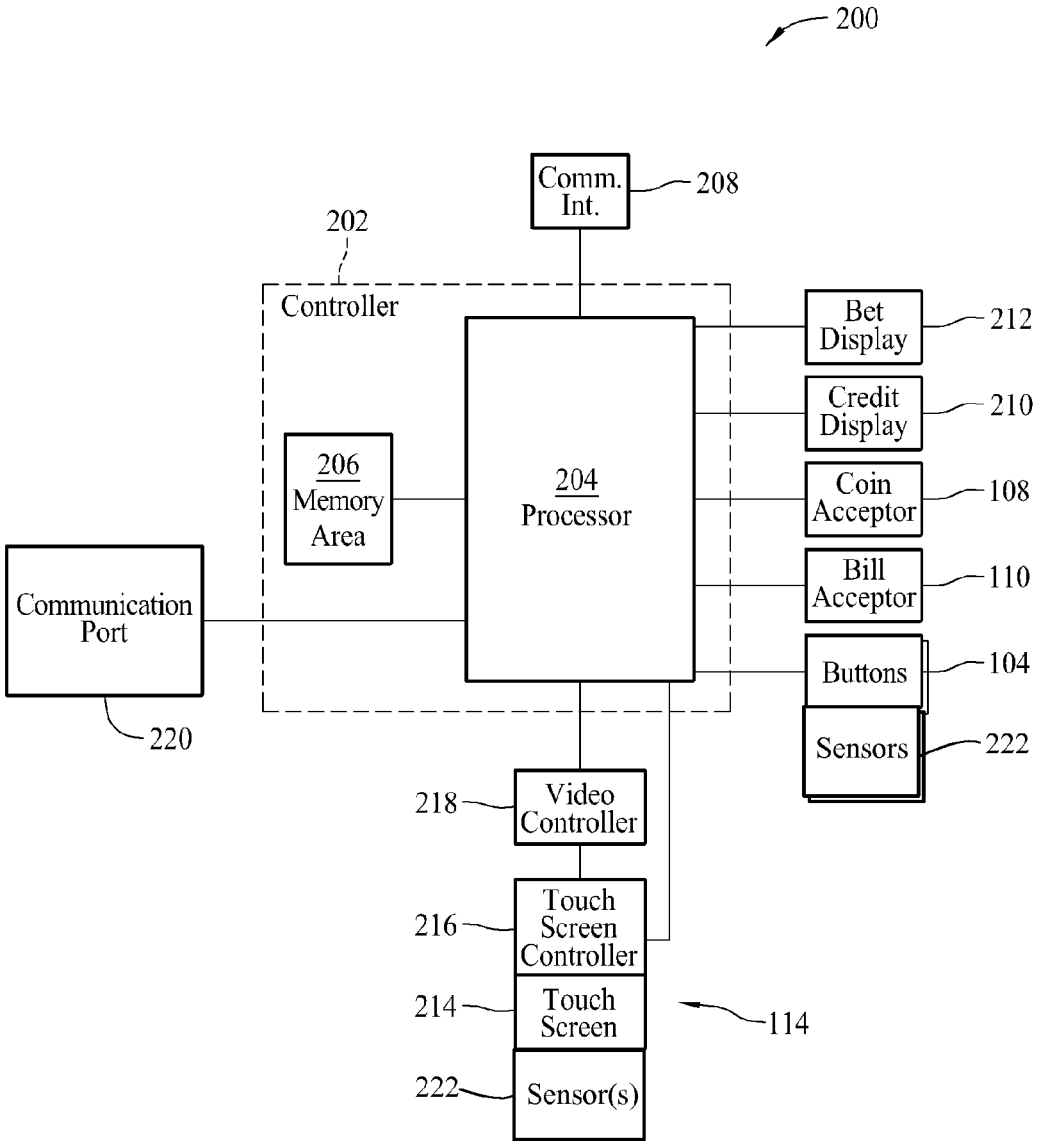
FIG. 2 is a schematic block diagram of an exemplary electrical architecture that may be used with the gaming machine shown in FIG. 1.

FIG. 2 is a schematic block diagram of an exemplary electrical architecture 200 that may be used with gaming machine 100. In the exemplary embodiment, gaming machine 100 includes a gaming machine controller 202, a processor 204, and memory area 206 residing within cabinet 102 (shown in FIG. 1) and may be collectively referred to herein as a "computer" or "controller." Gaming machine 100 is configurable and/or programmable to perform one or more operations described herein by programming processor 204. For example, processor 204 may be programmed by encoding an operation as one or more executable instructions and providing the executable instructions in memory area 206 to perform the process shown in FIG. 4.

Controller 202 communicates with one or more other gaming machines 100 or other suitable devices via a communication interface 208. Communication interface 208 may operate as an input interface (e.g., by receiving data from another device) and/or as an output interface (e.g., by transmitting data to another device). Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 206 stores program code and instructions, executable by processor 204, for controlling gaming machine 100. For example, memory area 206 stores data such as image data, event data, player input data, random or pseudo-random number generation software, pay table data, trigger event conditions, game play events, game play outcomes, and/or other information or applicable game rules that relate to game play on gaming machine 100. Further, memory area 206 may store acceptable interaction threshold levels associated with an input device (e.g., player interface 214 and buttons 104) and player data associated with an interaction of the player with the input device during play of a game on gaming machine 100. Moreover, memory area 206 may include one or more forms of memory. For example, memory area 206 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 206 by itself or in combination. In one embodiment, the above data and program code and instructions, executable by processor 204 for determining a mental state of a player during play of a game on gaming machine 100. For example, the data and the computer-executable instructions may be stored in a cloud service, a database, or other memory area accessible by gaming machine 100. Such embodiments reduce the computational and storage burden on gaming machine 100. As such, memory area 206 may be a local and/or a remote computer storage media including memory storage devices.

In the exemplary embodiment, gaming machine 100 includes a credit display 210, which displays a player's current number of credits, cash, account balance or the equivalent. Gaming machine 100 also includes a bet display 212, which displays a player's amount wagered. Credit display 210 and bet display 212 may be standalone displays independent of presentation device 114, or credit display 210 and bet display 212 may be incorporated into presentation device 114.

Moreover, in an exemplary embodiment, presentation device 114 is controlled by controller 202. In some embodiments, presentation device 114 includes a touch screen 214 (e.g., a capacitive touch screen display with a touch-sensitive surface that is integrated into gaming machine 100), an associated touch screen controller 216, and one more sensors 222. In one embodiment, sensors 222 are configured to measure data associated with an interaction of a player with touch screen 214 and/or buttons 104 (herein collectively referred to as "input device") during play of a game on gaming machine 100. In one embodiment, an accelerometer (not shown) may be used in place of sensors 222 or in conjunction with sensors 222. In another embodiment, sensors 222 are configured to measure an amount of pressure applied to touch screen 214 and/or button(s) 104, an amount of force applied to touch screen 214 and/or button(s) 104, a duration of force applied to touch screen 214 and/or button(s) 104, a frequency of force applied to touch screen 214 and/or button(s) 104, and/or a click accuracy (e.g., a comparison between "clicks" in active controls on a touch screen versus clicks in passive areas in which there is no sense in clicking) with respect to touch screen 214. As described in further detail below, by collected the data measured by sensors 222, a mental state of a player during play of a game on gaming machine 100 may be determined.

Accordingly, presentation device 114 may operate as an input device in addition to presenting information. A video controller 218 is communicatively coupled to controller 202 and touch screen controller 216 to enable a player to input game play decisions (e.g., actions) into gaming machine 100 via touch screen 214. Furthermore, gaming machine 100 includes one or more communication ports 220 that enable controller 202 to communicate with external peripheral devices (not shown) such as, but not limited to, external video sources, expansion buses, other displays, a SCSI port, or a key pad.

Figure 3:
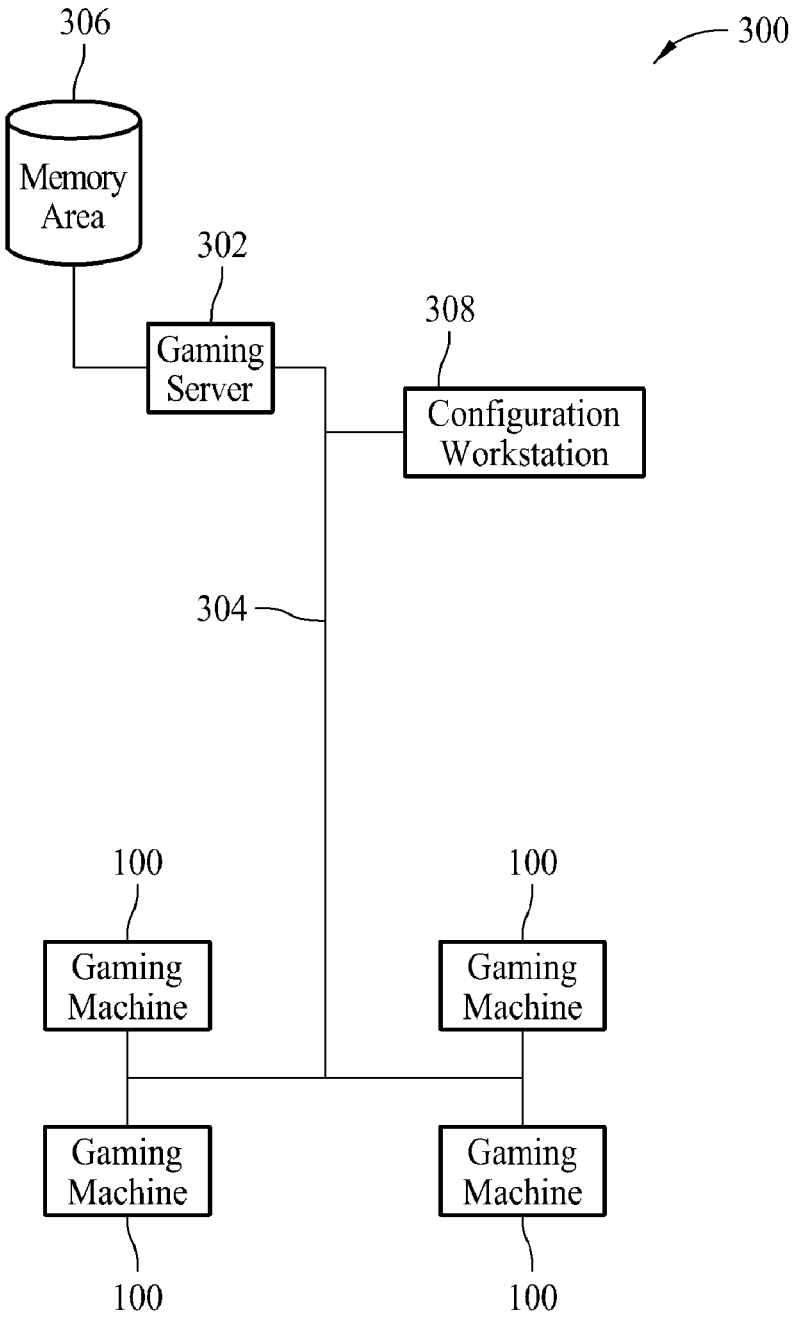
FIG. 3 is a block schematic diagram of an exemplary gaming system that includes a plurality of gaming machines shown in FIG. 1.

FIG. 3 is a block schematic diagram of an exemplary gaming system 300 that includes a plurality of gaming machines 100. Each gaming machine 100 is coupled via communication interface 208 (shown in FIG. 2) to one or more servers, such as a gaming server 302, using a network 304. Gaming server 302 includes a processor (not shown) that facilitates data communication between each gaming machine 100 and other components of gaming system 300. Such data is stored in, for example, a memory area 306, such as a database, that is coupled to gaming server 302.

In one embodiment, one or more gaming machines 100 may be remote gaming machines that access a casino over network 304. As such, a player is able to participate in a game of chance on a remote gaming machine. In this embodiment, it will be understood that a player operating a remote gaming machine has virtual access to any casino coupled to network 304 and associated with gaming server 302. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance, remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 302. In such an embodiment, gaming machines 100 display results of a game via presentation device 114 (shown in FIGS. 1 and 2).

In one embodiment, gaming server 302 performs a plurality of functions including, for example, game outcome generation, executing a game play event for a player, player tracking functions, accounting functions, and/or player mental state determination to name a few. However, in alternative embodiments, gaming system 300 may include a plurality of servers that separately perform these functions and/or any suitable function for use in a network-based gaming system.

Figure 4:
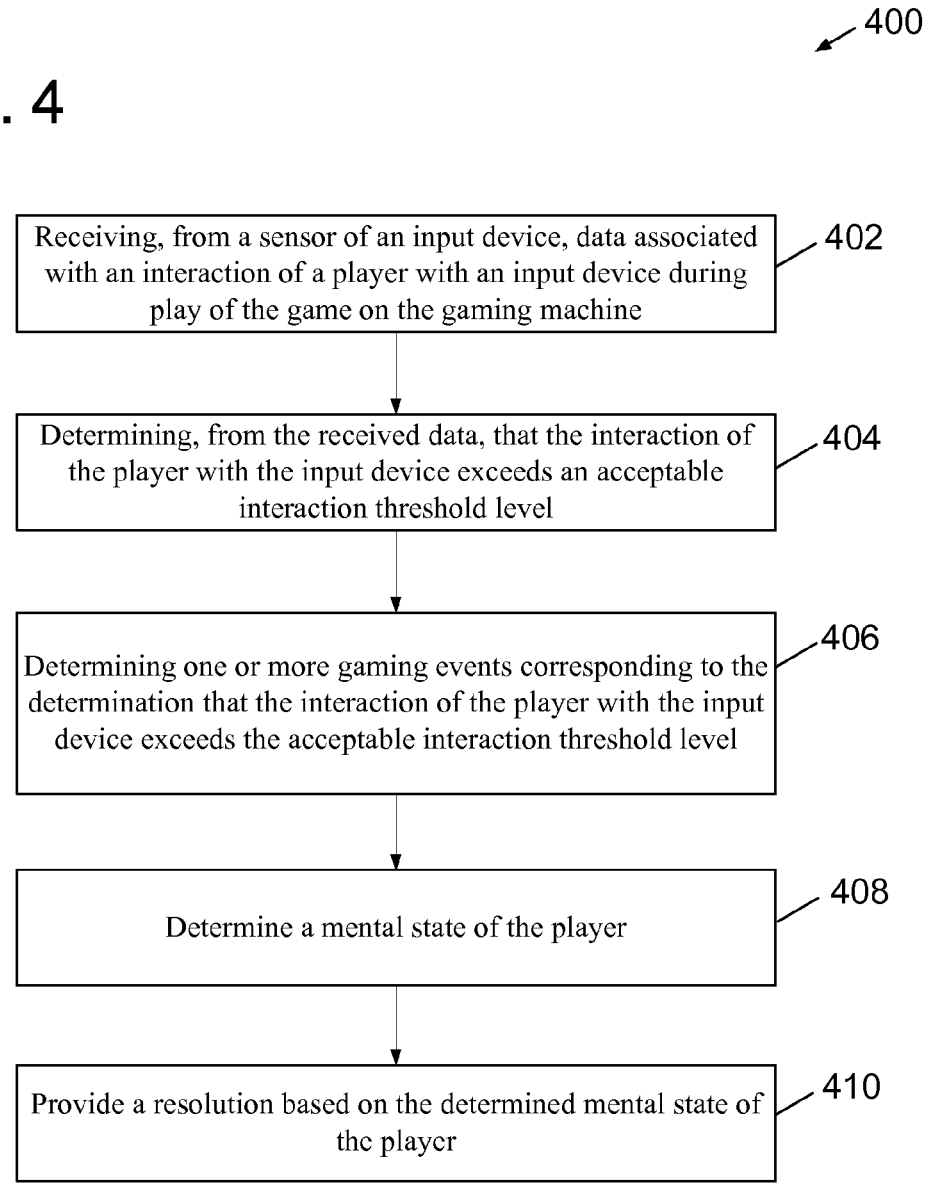
FIG. 4 is a flowchart that illustrates an exemplary method for detecting a mental state of a player during play of game of chance on the gaming machine shown in FIG. 1.

With reference now to FIG. 4, a flowchart that illustrates an exemplary method 400 for determining a mental state of a player during play of a game on gaming machine 100 is provided. In one embodiment, the mental state of the player may be a level of stress, a level of positive excitement, a level of negative excitement, a level of depression, a level of boredom, a level of intoxication, and the like.

At 402, data associated with an interaction of the player with the input device (e.g., touch screen 214 or buttons 104) during play of the game on gaming machine 100 is received from a sensor (e.g., sensor 222) of the input device. In one embodiment, the measured data comprises one or more of the following: an amount of pressure applied to the input device, an amount of force applied to the input device, duration of force applied to the input device, a frequency of force applied to the input device, and click accuracy. For example, the measured data may detect that a player is punching/hitting the input device to an extent that may damage the input device and/or gaming machine 100. In addition, the measured data may not only determine that a player is hitting the input device, but doing it repeatedly when only one "push/click/selection" is needed. At 404, it is determined, from the received data, that the interaction of the player with the input device exceeds an acceptable interaction threshold level. In one embodiment, the acceptable interaction threshold level is one or more of the following: a threshold amount of pressure applied to the input device, and a threshold amount of force applied to the input device. These threshold levels may be pre-defined, manually inputted by a user/administrator, a manufacturer, or developed overtime by collected data from a plurality of players. In one embodiment, the threshold level indicates a level of force that when exceeded, may damage the input device and/or gaming machine 100.

At 406, one or more gaming events that correspond to the determination that the interaction of the player with the input device exceeds the acceptable interaction threshold level are determined. In one embodiment, a gaming event may be one or more of the following: a win, a loss, a number of consecutive losses, a number of credits awarded, a number of credits lost, a close loss, a close win, and no input being required. For example, a determination is made as to what gaming event(s) caused the player to react in a way that resulted in the interaction of the player with the input device to exceed the acceptable interaction threshold level. Thus, if a player pounds the input device after losing a hand of poker, it may be determined that the loss of the hand of poker caused the player to pound the interface device. Further, if a player holds down the input device for a long period of time no matter if the player wins or loses, it may be concluded that the player holds down the input device thereafter for good luck.

At 408, a mental state of the player is determined based on the one or more gaming events, and the determination that the interaction of the player with the input device exceeds the acceptable interaction threshold level. For example, if it is determined that a player has increasingly exceeded a force threshold level on the input device, it may be determined that the player is stressed and/or his/her stress level is rising. At 410, a resolution based on the determined mental state of the player is provided. For example, if it is determined that a player is extremely excited over a win, a message may appear that says "Congratulations!! Take a few deep breaths and enjoy this moment!" However, if it is determined that a player is stressed or depressed, a message may appear that says "Press 'STOP' to take a break for a while or 'I'm OK' to continue." In some embodiments, if a player is determined to be in an unhealthy mental state (e.g., the player is determined to be aggressive, stressed, depressed, etc.), gaming machine 100 may cash out the player and/or signal security/an employee to remove the player from the gaming machine.

In one embodiment, prior to determining a mental state of the player, a mental state calibration phase is executed to establish a mental "baseline" or median to monitor, for example, stress levels in relation to the baseline/median. That is, to optimize the ability to determine a mental state of a player, measured data from sensor 222 may be collected for a defined period of time prior to determining a mental state of the player. During the calibration phase, gaming events that correspond to the collected measured data are determined, and based the collected information, a median mental state threshold for the player for each of the associated gaming events may be determined.

In another embodiment, gaming server 302 may collect data from a plurality of gaming machines/players and/or each gaming machine 100 may collect data from a plurality of players. In this embodiment, gaming server 302 and/or gaming machine 100 may detect patterns in mental states related to specific games and/or gaming machines. As such, this information may be utilized to improve upon each of the games/gaming machines by eliminating/altering parts of the games/gaming machines that repeatedly induce an unhealthy mental state in players. Further, this information may be utilized to improve upon each of the games/gaming machines to increase parts of the games/gaming machines that repeatedly induce a healthy mental state in players. Further, mental states such as boredom and lack of focus may be used to make a game/gaming machine more exciting. Furthermore, this data may also be used for gaming machine manufacturers to understand why certain input devices break more often than others, which also enables them to reinforce/redesign these input devices as needed as they have a better understanding of the cause.

One of ordinary skill in the art, guided by the teaching herein will appreciate that one or more operations in method 400 may be performed repeatedly. For example, game play events may be received repeatedly, and at least a portion of the steps described above may be performed based on each game play event.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," "including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming system comprising:

an input device configured to receive an interaction from a player, the input device comprising a sensor configured to measure the interaction of the player with the input device, wherein the sensor comprises at least one of an accelerometer, a pressure sensor, and a force sensor; and a processor programmed to:

carry out a player action in a game conducted on the gaming system in response to receiving the interaction by the input device, the player action associated with the input device;

receive measured data from the sensor;

determine, from the measured data, the interaction of the player with the input device exceeds an acceptable interaction threshold level;

associate one or more gaming events within the game with the determination that the interaction of the player with the input device exceeds the acceptable interaction threshold level, wherein the one or more gaming events correspond to the interaction of the player; and determine a mental state of the player based on:

the associated one or more gaming events; and the determination that the interaction of the player with the input device exceeds the acceptable interaction threshold level.

2. The gaming system in accordance with claim 1, wherein the processor is further programmed to execute a mental state calibration phase, wherein executing a mental calibration phase comprises:

collecting measured data from the sensor for a defined period of time;

associating gaming events that correspond to the interaction of the player;

comparing the collected measured data with the associated gaming events; and based on the comparing, determining a median mental state threshold for the player for each of the associated gaming events.

3. The gaming system in accordance with claim 1, wherein the mental state comprises one of the following: a level of stress; a level of positive excitement; a level of negative excitement; a level of depression; a level of boredom; and a level of intoxication.

4. The gaming system in accordance with claim 1, wherein the measured data comprises one or more of the following: an amount of pressure applied to the input device; an amount of force applied to the input device; a duration of force applied to the input device; a frequency of force applied to the input device; and a click accuracy.

5. The gaming system in accordance with claim 1, wherein the acceptable interaction threshold is one or more of the following: a threshold amount of pressure applied to the input device; and a threshold amount of force applied to the input device.

6. The gaming system in accordance with claim 1, wherein a gaming event comprises one or more of the following: a win; a loss; a number of consecutive losses; a number of credits awarded; a number of credits lost; a close loss; a close win; and no input being required.

7. The gaming system in accordance with claim 1, wherein the input device comprises at least one of a touch screen and a button.

8. The gaming system in accordance with claim 1, wherein the processor is further programmed to provide a resolution based on the determined mental state of the player.

9. The gaming system of claim 1, wherein the processor is further programmed, in carrying out the player action, to initiate a cash-out action for the player.

10. The gaming system of claim 1, wherein the processor is further programmed, in carrying out the player action, to initiate a spin of at least one reel in the game.

11. The gaming system of claim 1, wherein the processor is further programmed, in carrying out the player action, to place a wager for the player in the game.

12. A method for determining a mental state of a player during play of a game on a gaming machine, the method comprising:

receiving an interaction of a player at an input device;

carrying out a player action within the game for the player in response to receiving the interaction by the input device, the player action associated with the input device;

receiving, from a sensor of the input device, data associated with the interaction of the player with the input device, wherein the sensor comprises at least one of an accelerometer, a pressure sensor, and a force sensor;

determining, from the data, that the interaction of the player with the input device exceeds an acceptable interaction threshold level;

identifying one or more gaming events within the game corresponding to the interaction of the player; and determine a mental state of the player based on:

the one or more gaming events; and the determination that the interaction of the player with the input device exceeds the acceptable interaction threshold level.

13. The method in accordance with claim 12, further comprising:

executing a mental state calibration phase, wherein executing a mental calibration phase comprises:

collecting measured data from the sensor for a defined period of time;

identifying gaming events that correspond to the interaction of the player with the input device over the defined period;

comparing the collected measured data with the identified gaming events; and based on the comparing, determining a median mental state threshold for the player for each of the identified gaming events.

14. The method in accordance with claim 12, wherein the mental state comprises one of the following: a level of stress; a level of positive excitement; a level of negative excitement; a level of depression; a level of boredom; and a level of intoxication.

15. The method in accordance with claim 12, wherein the measured data comprises one or more of the following: an amount of pressure applied to the input device; an amount of force applied to the input device; a duration of force applied to the input device; a frequency of force applied to the input device; and a click accuracy.

16. The method in accordance with claim 12, wherein a gaming event comprises one or more of the following: a win; a loss; a number of consecutive losses; a number of credits awarded; a number of credits lost; a close loss; a close win; and no input being required.

17. The method in accordance with claim 12, further comprising providing a resolution based on the determined mental state of the player.

18. The gaming system of claim 12, wherein carrying out the player action comprises initiating a cash-out action for the player.

19. The gaming system of claim 12, wherein carrying out the player action comprises initiating a spin of at least one reel in the game.

20. The gaming system of claim 12, wherein carrying out the player action comprises placing a wager for the player in the game.

21. An input device that enables a player to execute one or more inputs in a game of chance on a gaming machine, the input device comprising:

an interface configured to receive an interaction from the player;

transmit a signal to a game controller indicating a player action to be carried out within the game of chance in response to receiving the interaction by the interface, the player action associated with the interface;

a sensor, the sensor configured to measure data associated with the interaction of the player with the input device, wherein the sensor comprises at least one of an accelerometer, a pressure sensor, and a force sensor; and a processor programmed to:

receive measured data from the sensor;

determine, from the measured data, that the interaction of the player with the input device exceeds an acceptable interaction threshold level;

associate one or more gaming events within the game of chance with the determination that the interaction of the player with the input device exceeds the acceptable interaction threshold level, wherein the one or more gaming events correspond with the interaction of the player with the input device; and determine a mental state of the player based on:

the associated one or more gaming events; and the determination that the interaction of the player with the input device exceeds the acceptable interaction threshold level.

22. The input device in accordance with claim 21, wherein the processor is further programmed to execute a mental state calibration phase, wherein executing a mental calibration phase comprises:

collecting measured data from the sensor for a defined period of time;

associating gaming events that correspond to the interaction of the player with the input device;

comparing the collected measured data with the associated gaming events; and based on the comparing, determining a median mental state threshold for the player for each of the associated gaming events.

23. The input device in accordance with claim 21, wherein the mental state comprises one of the following: a level of stress; a level of positive excitement; a level of negative excitement; a level of depression; a level of boredom; and a level of intoxication.

24. The input device in accordance with claim 21, wherein the measured data comprises one or more of the following: an amount of pressure applied to the input device; an amount of force applied to the input device; a duration of force applied to the input device; a frequency of force applied to the input device; and a click accuracy.

25. The input device in accordance with claim 21, wherein the acceptable interaction threshold is one or more of the following: a threshold amount of pressure applied to the input device; and a threshold amount of force applied to the input device.

26. The input device in accordance with claim 21, wherein a gaming event comprises one or more of the following: a win; a loss; a number of consecutive losses; a number of credits awarded; a number of credits lost; a close loss; a close win; and no input being required.

* * * * *